US005230264A

United States Patent [19]

Kindling

[11] Patent Number: 5,230,264

[45] Date of Patent: Jul. 27, 1993

[54] QUICK ADJUST WRENCH

[76] Inventor: Oscar Kindling, P.O. Box 2574, Calexico, Calif. 92231

[21] Appl. No.: 894,660

[22] Filed: Jun. 5, 1992

[51] Int. Cl.[5] ..... B25B 13/34

[52] U.S. Cl. ..... 81/151; 81/129

[58] Field of Search ..... 81/129, 142, 143, 145, 81/151, 154

[56] References Cited

U.S. PATENT DOCUMENTS

| | | | |
|---|---|---|---|
| 742,055 | 10/1903 | Ondrey | 81/143 |
| 762,762 | 6/1904 | Rowe | 81/145 |
| 910,737 | 1/1909 | Stenz | 81/143 |
| 991,602 | 5/1911 | Bradley | 81/143 |
| 1,903,052 | 3/1933 | Kerlin | 81/154 |

*Primary Examiner*—James G. Smith

*Attorney, Agent, or Firm*—Ralph S. Branscomb

[57] ABSTRACT

A quick-adjust wrench utilizes a sliding jaw which slides with a casing which straddles the wrench shank and captures therein a pawl which rides in a groove extending longitudinally in the shank. A rocker rocks against the pawl when the wrench jaws try to expand, forcing the pawl into its groove in the wrench shank with great force, securely lodging the jaw with respect to the wrench shank to prevent further expansion. This mechanism provides the wrench with infinite and instant adjustability and a very positive, play-free action.

15 Claims, 1 Drawing Sheet

Fig. 1
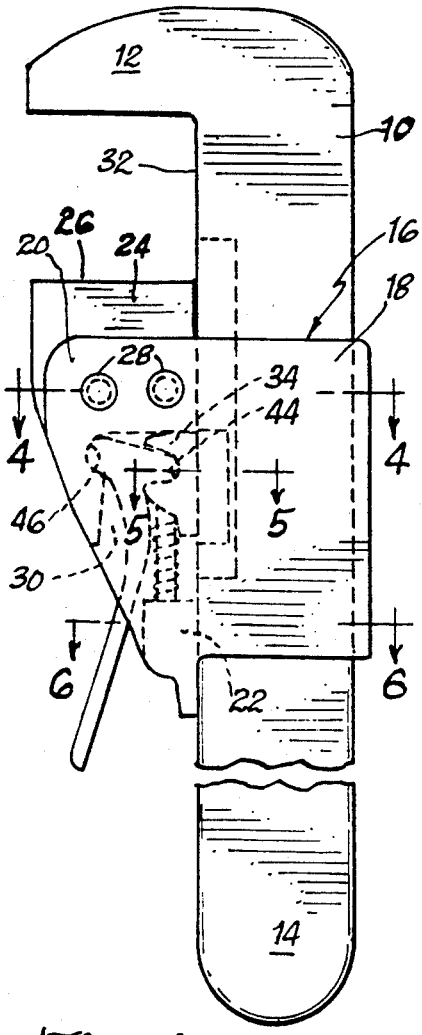
Fig. 2
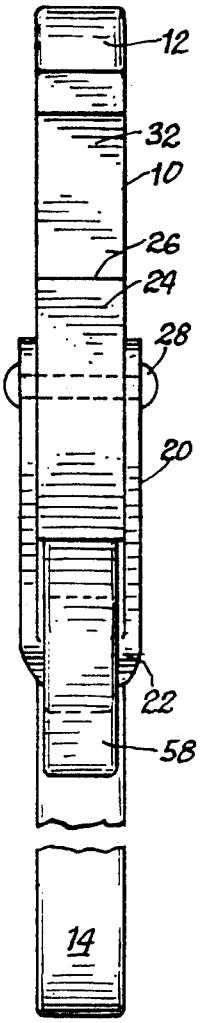
Fig. 3
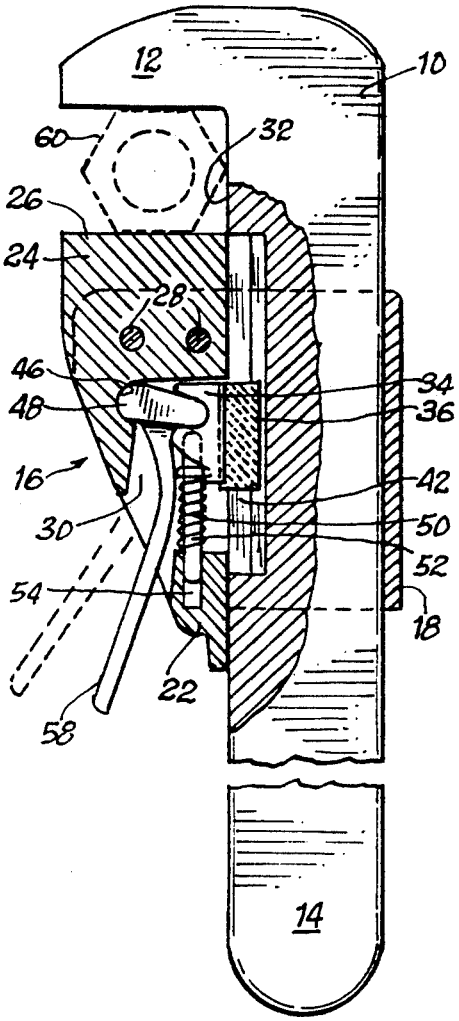
Fig. 4
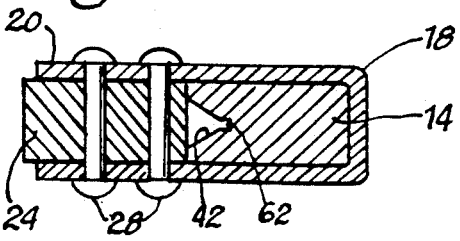
Fig. 5
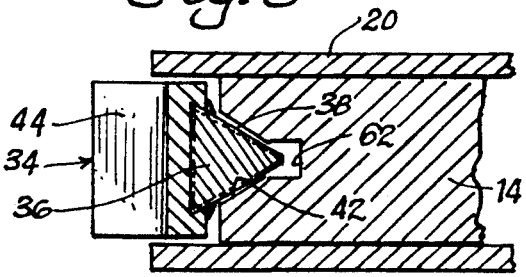
Fig. 6
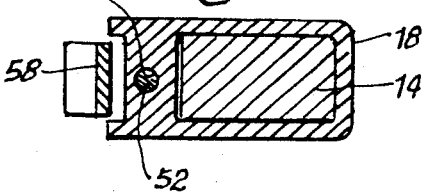
Fig. 7
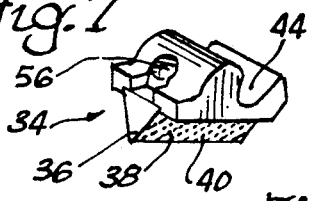
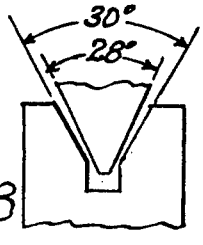
Fig. 8

QUICK ADJUST WRENCH

BACKGROUND OF THE INVENTION

The invention is in the field of adjustable wrenches, which includes crescent wrenches, pipe wrenches, and monkey wrenches. These wrenches have in common the fact that they are all adjustable. The jaws of the respective wrench must be capable of expanding or contracting to accommodate a variety of sizes of bolts or pipes, and the wrench must be capable of locking in the engaged mode, and relatively easily disengagable.

Over the years, there have been dozens if not hundreds of adjustable wrench designs, with probably the most popular being the simple, rotary-nut wrench in which one rotates the adjustment nut laterally of the handle or shank of the wrench to open or close the jaws, to achieve the appropriate jaw spacing.

That embodiment of the adjustable wrench has several advantages. First, it is very basic and simple. The loosely threaded, transversely rotating knurled nut used to adjust the wrench is virtually foolproof. It is also fairly easy to make the adjustment mechanism quite strong. And, once adjusted, the sliding jaw will not slip under pressure, although sometimes there may be an undesirable slack in the jaw spacing that must be used up before the sliding jaw become fixed.

With all these advantages, there is still a principle disadvantage in the classic adjustable wrench that has been behind the majority of sliding jaw adjustable wrench innovations. That drawback lies in the fact that adjusting the jaw spacing over a large distance is somewhat tedious and time consuming, requiring repeated rotation of the adjusting nut until the jaws open or close.

The ideal adjustable wrench would have a sliding jaw that is both quite freely slidable when it is not under tension, but becomes instantly immobile when expansive force is applied to the jaws with as little play as possible. The wrench must then have an easily usable sliding jaw release which does not require inordinate force.

The following devices have appeared in U.S. patents over the years in an attempt to provide such a wrench:

| PAT. No. | ISSUE DATE | TITLE | INVENTOR |
|---|---|---|---|
| 1. 12,510 | March 13, 1855 | Pipe Wrench | J. Hyde |
| 2. 16,158 | December 2, 1986 | Wrench | O. O. Witherell |
| 3. 26,468 | December 20, 1859 | Wrench | A. J. Bell |
| 4. 61,097 | January 8, 1867 | Wrench | T. Pratt |
| 5. 254,507 | March 7, 1882 | Wrench | Schneider |
| 6. 686,437 | November 12, 1901 | Wrench | G. W. Boozer |
| 7. 705,860 | July 29, 1902 | Wrench | J. O'Brien |
| 8. 753,837 | March 8, 1904 | Monkey Wrench | L. C. Barcus |
| 9. 1,886,146 | October 14, 1932 | Adj. Wrench | F. H. Andrews |
| 10. 1,903,052 | March 28, 1933 | Wrench | J. R. Kerlin |
| 11. 3,563,118 | February 16, 1971 | A.S.L. Wrench | E. Rydell |

Quick-adjusting wrenches thus date back to well before the civil war. Typically, they work on either a cam mechanism or a ramp mechanism whereby expansion of the jaws causes a wedge, ramp, or cam to move, creating a resistive expansive force on another member which stops expansion of the jaws. There is generally some type of lever mechanism which pops the ramp or cam free, or at least reduces the pressure on the element substantially, so that the moveable jaw can be easily moved to open the jaws.

The mechanism most closely resembling applicant's device is illustrated in the Boozer patent, U.S. Pat. No. 686,437. In that device, a movable "pressure plate" translates longitudinal jaw motion into transverse pressure against the wrench shank when the sliding jaw expands. Whereas the Boozer wrench might have been viable in its time, it does not optimize stress distribution as it should in order to maximize wrench life, and its mechanism, although advantageous in that it is simple, is somewhat primitive in that it is doubtful whether it would have a smooth sliding action, and its repeated use would seem to scar the inner face of the wrench shank considerably.

There is a need for a simple, quickly adjustable wrench which achieves the above-stated objectives of an optimal quickly adjustable wrench while avoiding the pitfalls of the wrenches disclosed in the above-enumerated patents.

SUMMARY OF THE INVENTION

The wrench of the instant invention has the usual long shank with the fixed jaw at one end and the wrench handle at the other end, with the sliding jaw being mounted on a casing or shackle that slides up and down the shank.

On the jaw side of the main wrench shank there is a longitudinal V-shaped groove which spans a distance equal to the desired throw of the lower, sliding jaw. There is slidably seated in this groove a pawl with a corresponding V-shaped tongue which is pressed into the groove. The pawl links to the sliding casing both through a coil spring which urges the pawl upward toward the fixed jaw, and through a rocker which is captured between the pawl and an opposite concavity in the casing.

When expansive pressure is applied on the jaws, such as when turning a nut or bolt engaged between the jaws the sliding jaw moves to rotate the rocker in such a way that it cams against the pawl, translating the longitudinal motion of the sliding jaw into a lateral compressive force between the pawl and the groove in the wrench shank. A lever extending from the rocker is thumb- or finger-operated to relieve the compressive force between the pawl and the shank so that the wrench can be disengaged from the workpiece and the sliding jaw can again slide freely.

BRIEF DESCRIPTION OF THE DRAWINGS

FIG. 1 is a side elevation view of the wrench showing the internal workings in phantom;

FIG. 2 is an elevation view of the front of the wrench as shown in FIG. 1;

FIG. 3 is a side elevation view similar to FIG. 1 but showing the jaw in its compressed mode;

FIG. 4 is a section taken along line 4—4 FIG. 1;

FIG. 5 is a section taken along line 5—5 of FIG. 1;

FIG. 6 is a section taken along line 6—6 of FIG. 1;

FIG. 7 is a perpective view of the pawl removed from the rest of the assembly; and, FIG. 8 is a diagrammatic representation of the respective angles of the V-shaped tongue of the pawl as it fits into the V-shaped groove in the wrench shank.

DETAILED DESCRIPTION OF THE PREFERRED EMBODIMENT

The wrench has a long shank 10 which terminates in a fixed jaw 12, with the extended handle 14 at the other end. The shank, as with all of the other parts of the wrench, would normally be made out of steel or some other strong, rigid metal.

Riding on the shank is a sliding casing 16 which includes a saddle 18 surrounding the shank, a pair of side plates 20 and a bridging mass of material at 22. The rest of the casing is formed from a second piece in the form of block 24, the top of which forms the surface 26 of the sliding jaw. The block 24 is riveted at 28 between the slide plates 20 such that a chamber 30 is formed by the block sideplates, and the jaw side 32 of the shaft.

Within this chamber is a pawl 34 which is detailed in FIG. 7. The pawl is shown as being two-piece, but could easily be a single casting, and has a V-shaped tongue 36 formed by two side faces 38 which have frictional striations 40 which are angled at about 45 degrees. The tongue seats in the V-shaped groove 42 in the jaw side 32 of the shaft, and as the pawl is moved away from the fixed jaw, the striations tend to dig the tongue deeper into the groove. The tongue should be made of a material that is slightly softer than the shank so it wears out first, inasmuch as it is the more inexpensively replaceable of the two parts.

On the other side of the pawl element is a cavity 44 which cooperates with a similar cavity 46 in the block 24 to capture the rocker 48 therebetween. The rocker, block and pawl are at the heart of the action of the wrench. The pawl is urged toward the fixed jaw by means of a coil spring 50 which is maintained in position by a positioning stem 52 which seats in sockets 54 and 56 defined in the bridge 22 and pawl 34 respectively. This spring urges the pawl toward the fixed jaw 12, but also reacts off of the rocker 48 such that there is no slack between the rocker, pawl and groove structure as shown in FIG. 3.

When the wrench is used, the rocker lever 58 is pushed into the position shown in phantom in FIG. 3 by the thumb or a finger. This lever rotates the rocker so as to slacken the connection between the pawl and the groove to the extent necessary to permit the sliding casing 16 to slide freely, enabling the lower jaw to be brought around a workpiece such as the nut 60 shown in FIG. 3.

Once the wrench is securely engaged around the workpiece, the lever 58 is released, enabling the coil spring 50 to tighten the tongue 34 of the pawl into the groove 42.

At this point, if the wrench is used to turn the nut 60, the expansive forces exerted between the jaws force the sliding jaw away from the fixed jaw an almost unnoticeable amount, but enough to tighten even further the compression between the rocker, pawl and groove so that the sliding jaw is dogged against further movement. The rocker is angled with respect to the shank more perpendicular than parallel to increase the mechanical advantage of the nut torquing action in wedging the pawl.

This action is very positive and has almost no play. Once the wrench locks onto a nut, and the lever 58 is released, further expansion of the jaws is not possible without again raising the lever.

Two details of construction insure the maximum bite of the pawl tongue into the groove. First it has been found that if the side faces 38 of the tongue are cut to define an angle slightly less than that of the groove, the gripping action is better than a strictly parallel interface. As shown in FIG. 8, when the tongue is cut to twenty-eight degrees and the groove is thirty degrees, gripping action is excellent.

The second feature is the trough 62 which is cut into the wrench shank beneath the apex of the V-shaped groove 42. This space permits any debris that has accumulated between the interfaces to fall into, or be expelled into, the groove, to fall out or be wiped out later. It can be seen from an examination of FIG. 5 that absent the trough, it would be possible for shavings and bits of material to lodge between the tongue and the groove, reducing the friction and possibly occluding the serrated surface established by the striations 40, reducing their effect.

The simple combination of parts needed to make this wrench establishes a very smooth and positive action, together with enormous strength. As can be seen from FIG. 3, in the case that an enormous expansive force were put on the sliding jaw, the lower surface of the jaw block would come into contact with the upper surface of the pawl, stopping further increases on pawl pressure so that the rocker would not be thrown into an increasingly leveraged mode as it rotates counter-clockwise in that Figure, resulting in a lateral force exerted between the block and the pawl that approaches infinity. The action would be stopped before this force became destructive and exploded the wrench.

In summary of the operation of the wrench, to engage a nut, the jaws are first in an open position wider than the nut to be turned, as shown in FIG. 1. The saddle 18 is then pushed up toward the fixed jaw 12 either directly or by pushing up on the lever 58. Either way, the pressure of the pawl 34 against the groove 42 of the shank is relieved, permitting the saddle to slide. This is because of the angle of the cam or head portion of the rocker as it rests in the wrench. When the saddle is moved up from the position of FIG. 1, it urges the left portion of the rocker head upward, so that if there is any resistance experienced by the right side of the rockerhead caused by frictional engagement between the pawl and the shank, clockwise rotation of the rocker would lessen the distance at which the rocker held the cavity 46 and the cavity 44 of the pawl apart.

It should be noted that the spring stem 52 is mounted loosely enough in the socket 56 to permit free enough play of the pawl so that it may move left or right, as shown in FIGS. 1 and 3, adequately enough to either disengage or engage the tongue in the groove. The socket 56 is more of a hollow, and is adequately concave to ensure that the spring 50 urges the pawl upwardly, as shown in FIGS. 1 and 3, and does not snap out of the socket, but does not establish a rigid, axially sliding relationship between the spring stem and the pawl.

The spring 50 presses, or provides an expansive force, between the pawl and the lower portion of the saddle, as shown in FIG. 3. This pressure, urging the pawl upwardly, also tends to rock the rocker counter-clockwise, as shown in FIG. 3. As the rocker rocks counter-clockwise, its effective left-to-right dimension, as shown in FIG. 3, increases, which urges the pawl into the V-shaped groove 42.

This biasing of the pawl into the groove is light, but it is enough to hold the side faces of the pawl against the surfaces of the groove. For this reason, after the saddle is pressed up to move the moving jaw into bolt-engaging position, as shown in FIG. 3, there is no play between that jaws as the wrench is turned to rotate the nut or bolt 60.

As the wrench is turned, the nut 60 will apply an expansive force between the jaws of the wrench. This force will tend to rotate the rocker 48 counter-clockwise, as shown in FIG. 3. This attempted rotation applies a force lateral in the wrench handle, which compresses that tongue of the pawl into the groove. Because of the angle of the rocker 48, expansive pressure, caused by rotating the handle of the wrench, is delivered laterally to the pawl several fold, jamming it into the groove.

The striations 40 are illustrated as very light cuts or score lines angled such that they would tend to dig into the metal of the V-shaped groove 42. Naturally, the striations do not dig far into the groove or it would be damaged. The striations are in the nature of a friction-increasing surface feature on the sides of the tongue.

Thus, when the wrench is turned, after it has been tightly engaged on a nut 60, the moveable jaw 26 has virtually no play because of the fact that the coil spring 50 urges the pawl up against the right end of the rocker 48 causing the pawl to be pressed into the groove and the left portion of the saddle moved as far to the left as it will move. Naturally, there will be a very slight, scarcely visible movement of the moveable jaw 26 due to the slight compressibility of metal and the fact that any force applied to such a mechanism will cause a minuscule movement. However, the movement is insignificant. The main feature of the invention is the almost complete absence of play between the jaws as the wrench is rotated.

The parts of the wrench are basic and simple to produce, lacking the complexity of many of the prior attempts at quick-adjusting wrenches. Although clearly the concept of a quick-adjustment wrench has been around for along time, it is believed that none of the prior wrenches are as smooth in action, as strong, and offer as little as the wrench of this invention, and certainly they do not use the same mechanism.

It is hereby claimed:

1. A quick-adjust wrench comprising:

(a) an elongated shank having a handle end, and a head end mounting a fixed jaw;

(b) a sliding casing slidably mounted on said shank and defining a sliding jaw slidable on said shank alternatively toward or away from said first jaw;

(c) said shank having a jaw side and having an elongated converging groove defined longitudinally in said jaw side and extending at least a portion of the length of said shank parallel thereto, said groove converging from wider to narrower in the direction of increased penetration into said shank;

(d) a pawl frictionally engaged in said groove such that said groove serves the double function of acting as a guideway for said pawl and multiplying the frictional forces between the pawl and groove as a function of increased convergence of the grooves;

(e) a rocker captured between said casing and said pawl such that said pawl has a first end contacting a first location on said casing and a second end contacting a second location on said pawl, said first and second locations being spaced from one another to define a between-locations spacing such that the longitudinal component of the spacing in the direction longitudinally of the shank and normal to the sliding direction of said sliding jaw is less than the lateral component of the spacing transverse of the shank and the longitudinal component so that a longitudinal compressing force on said pawl is reacted as an amplified lateral force, such that as expansive forces are applied between said jaws, said pawl is driven into tighter frictional engagement with said groove with a compound mechanical advantage due to the leveraged orientation of the rocker and the converging sides of the groove on which the pawl bears.

2. Structure according to claim 1 wherein said rocker is at least slightly elongated and has rocker ends, and said casing and pawl each define a cavity to capture said rocker ends therebetween.

3. Structure according to claim 1 wherein said rocker includes a rocker lever which is finger-operable to rotate said rocker to substantially relieve the pressure of said pawl in said groove such that said pawl is slideable along said groove.

4. Structure according to claim 1 and including spring means biasing said pawl towards said fixed jaw relative to said casing.

5. Structure according to claim 4 wherein said spring means comprises a coil spring captured between said pawl and said casing.

6. Structure according to claim 5 and including a spring stem skewering said coil spring, and said casing and said pawl defining sockets capturing the ends of said spring stem therein.

7. Structure according to claim 1 wherein said groove is substantially V-shaped in cross section.

8. Structure according to claim 7 wherein said pawl defines a V-shaped tongue to seat in said groove.

9. Structure according to claim 8 wherein the vertex of said tongue defines a slightly sharper angle than the vertex of said groove.

10. Structure according to claim 9 wherein said V-shaped groove defines sides with a cross-sectional angle between same of on the order of thirty degrees, and the vertex of said tongue defines an angle on the order of two degrees narrower than the cross-sectional angle of said groove.

11. Structure according to claim 8 wherein the tongue of said pawl defines two converging sides having friction-enhancing serrations thereon.

12. Structure according to claim 11 wherein said serrations comprise substantially parallel striations angled down the converging sides of said tongue such that said striations tend to dig deeper into said groove as said sliding jaw separates from said fixed jaw.

13. Structure according to claim 8 wherein said shank defines a clearance trough along the vertex of said V-shaped groove to facilitate keeping said tongue and groove clear of debris.

14. Structure according to claim 8 wherein said tongue is made of a softer metal than the material of said shank which defines said groove.

15. Structure according to claim 1 wherein said rocker is elongated and defines a longitudinal direction which more closely approaches perpendicularity rather than parallelism with said shank when expansive force is applied to said sliding jaw.

* * * * *